United States Patent [19]

Vossen

[11] Patent Number: 4,505,422

[45] Date of Patent: Mar. 19, 1985

[54] CONTAINER MADE OF CARDBOARD OR THE LIKE MATERIAL AND BLANK FOR SAID CONTAINER

[75] Inventor: Franz Vossen, Radolfzell, Fed. Rep. of Germany

[73] Assignee: Meurer Non-Food Product GmbH, Radofzell, Fed. Rep. of Germany

[21] Appl. No.: 427,520

[22] Filed: Sep. 29, 1982

[30] Foreign Application Priority Data

Nov. 16, 1981 [DE] Fed. Rep. of Germany ... 8133449[U]

[51] Int. Cl.[3] ..... B65D 5/02

[52] U.S. Cl. ..... 229/37 R; 229/44 R

[58] Field of Search ..... 229/44 R, 37 R, 38, 229/17 R

[56] References Cited

U.S. PATENT DOCUMENTS

| | | | |
|---|---|---|---|
| 1,481,161 | 1/1924 | Tasler | 229/37 R X |
| 1,723,150 | 8/1929 | Gannon et al. | 229/37 R |
| 2,187,304 | 1/1940 | Farmer | 229/37 R |
| 2,516,085 | 7/1950 | Williamson | 229/37 R |
| 2,701,679 | 2/1955 | Goldstein | 229/17 R |
| 2,848,152 | 8/1958 | Geiger | 229/17 R |
| 3,002,673 | 10/1961 | Asman | 229/17 R |
| 3,114,494 | 12/1963 | Wasyluka | 229/37 R |
| 3,262,631 | 7/1966 | Belsinger | 229/44 R |
| 3,297,229 | 1/1967 | Bluem | 229/37 R |
| 3,297,230 | 1/1967 | Stegner | 229/38 |
| 3,473,723 | 10/1969 | Bolling, Jr. et al. | 229/37 R |
| 3,481,527 | 12/1969 | Jacke | 229/37 R |

FOREIGN PATENT DOCUMENTS

| | | | |
|---|---|---|---|
| 58323 | 6/1953 | France | 229/37 R |

*Primary Examiner*—William Price
*Assistant Examiner*—Gary E. Elkins
*Attorney, Agent, or Firm*—Roberts, Spiecens & Cohen

[57] ABSTRACT

A container is made of cardboard or the like material—and a pattern or blank from which said container is assembled—and has walls which are joined intimately to a base, a lid flap or flaps on one or one pair of these walls surrounding an opening to the container interior, and lying transverse to that lid flap, dust flaps which when the container is closed face the inner side of the lid flap/flaps. Said container is intended for contents of a finely divided form which could give rise to dust, and is able to prevent this dust formation.

To this end the edges at the sides of the dust flap extend on both sides beyond the delimiting wall section a distance from the related fold line to produce peaklike areas; each of which is delimited by a curved contour and are joined to another wall which is adjoined to and is at an angle to that wall section, the edge at the side of the dust flap featuring a radial curvature at least in the region next to the fold line. Further, the leading edges of a pair of dust flaps which feature slits at the leading edge should support the inner surface of the lid flap/-flaps; the leight of the dust flaps should be less than half that of the dust flap/flaps.

11 Claims, 8 Drawing Figures

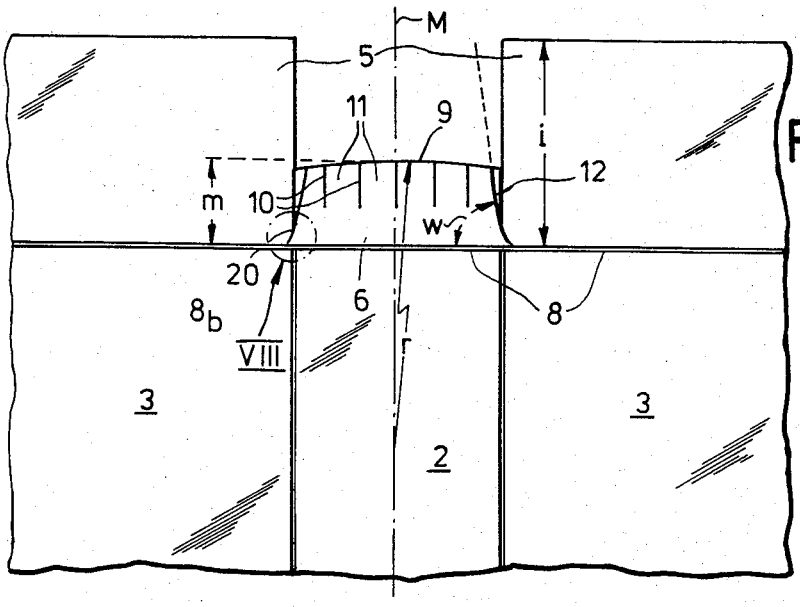
Fig.3
Fig.5
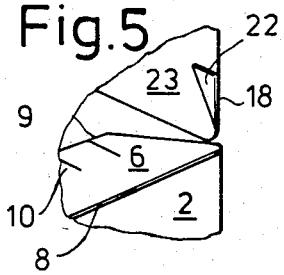
Fig.4
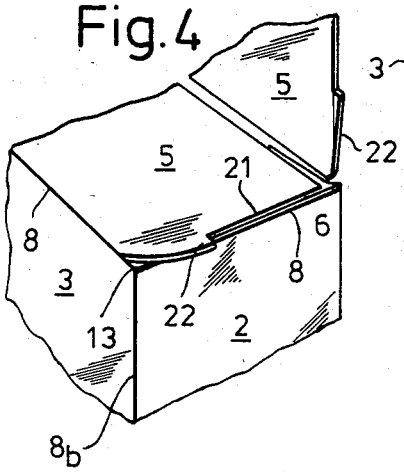
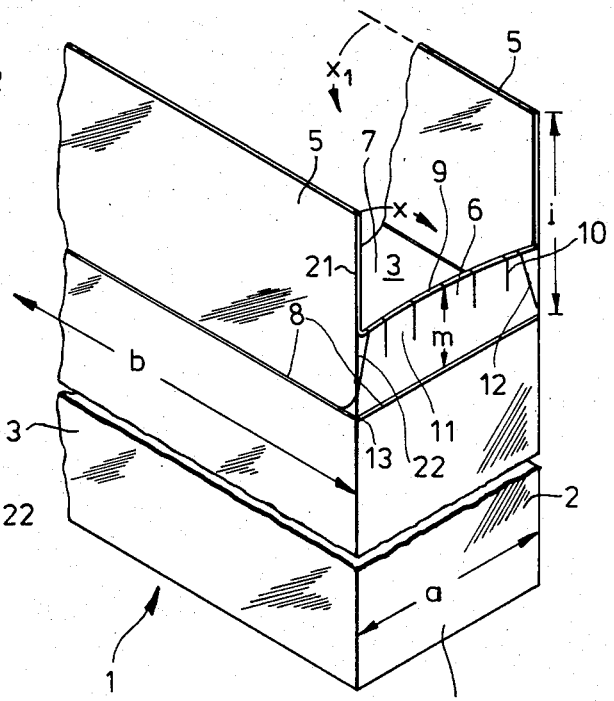
Fig.2

CONTAINER MADE OF CARDBOARD OR THE LIKE MATERIAL AND BLANK FOR SAID CONTAINER

BACKGROUND OF THE INVENTION

The invention relates to a container made of cardboard or like material which has walls made up of a plurality of wall sections—partly delimited by a fold line or fold lines—joined intimately to a base, at least one lid flap at an opening surrounded by said wall sections, and also dust flaps which lie transverse to the lid flap and face the inner surface of the lid flap/flaps when the container is closed, there being at least one fold line running between the lid flap and a neighbouring wall section over the breadth of the same starting from the edge at the side of the flap. Furthermore, the invention also relates to a pattern or blank from which the container is assembled.

Known containers of the above kind are employed to hold various kinds of substances. If these substances are in the form of finely divided dust-like material, or tend to create dust, it is necessary to have an additional container, for example a bag, pouch or the like to be placed inside the cardboard container. The reason for this is that up to now it has not been possible to make a dust-tight container from a cardboard blank without providing some additional facility.

SUMMARY OF THE INVENTION

In views of the above it is an object of the preset invention to provide a container—and blank or pattern therefor—of the aforesaid kind which, without problem, is able to contain substances tending to create dust, and is able to do so without requiring a special insert or inlay.

This object is achieved by the invention in which the edges at the side of the dust flap—or optionally the edges of the lid flaps—project out at both sides of the neighboring wall section beyond this section and extend a distance from its delimiting fold line to form peak-like areas which feature a curved edge and are joined to another wall section which is adjoined to and is at an angle to the neighboring wall section, the edge at the sides of the dust flap or lid flap having a radial curve at least in the region next to the fold line. The peak-like projections on the sides of the dust flap or lid flap, folded over when the container is closed, thus provide additional protection at the critical corners of the closure means of the container.

Furthermore, the leading edge of the dust flap should be curved in such a way that its height is less at the sides than in the middle.

Consequently, on closing the container, this leading edge presses against the contacting lid flap; this effect is reinforced further by providing slits in the region of the leading edge of the dust flap.

As a result of these measures, including the fact that the height of the dust flap is not great, it is now possible to ensure a dust-tight closure of the container, without problem and in a single operation.

Although features described in greater detail in the claims contribute to improvement of containers or boxes of the basic type, a secure dust-tight closure is assured by the provision of relatively short dust flaps with slits running from their leading edge, and the provision of peak-like regions projecting out of the side edges of the dust flap. As a result of the curvature of the leading edge of the dust flap, the lip of the dust flap conforms easier to the shape of the lid flap—an effect which is further enchanced by the presence of the slits at the leading edge of the dust flap. These slits also make it possible for the chalk, heavy spar or barite surface of the cardboard—which does not readily accept adhesive—to be broken through and made more suitable for sticking. In addition, the described creation of tongues on the dust flap makes it possible for the dust flap to conform to the lid flap even when the latter is curved in cross section. The high pressure produced at the leasing edge of the dust flap as a result of this design facilitates considerably the adhesive sealing of the container as it is closed.

In the finished box, the peak-like edge regions are led around their corners and joined to the neighboring front side of the box. In this respect it has been shown to be particularly favorable to extend the line of curvature on the peak-like regions upwards and at an angle to the line representing the middle of the narrow side—preferably at an angle of about 80° so that, at the then sloping edge at the sides of the dust lid, such projections are formed at the flanking lid flaps so that when the box is closed these projections overlap the corner region or form a bead or flap thereat.

Of particular significance with respect to dust—tight closure is the described shape of the edges at the sides of the dust flap; these edges begin as a gentle curve at the fold line of the box side wall and continue as a line running at an angle to the line representing the middle of the narrow side. Together with the curved leading edge on the dust flap, this shape of the sides of the dust flap permits an extremely close fit to the lid flap/flaps.

BRIEF DESCRIPTION OF THE DRAWINGS

Further advantages, features and details of the invention are revealed in the following description of the preferred exemplified embodiments represented by the schematic drawings in which:

FIG. 2 is a corresponding representation of another box;

FIG. 3 is a plan view of a part of a cardboard blank for manufacturing the box shown in FIG. 2;

FIG. 4 shows a part of the box in FIG. 2, partly closed.

FIG. 5 shows a further detail of the box shown in FIG. 2.

DESCRIPTION OF THE PREFERRED EMBODIMENTS

Figure 1:
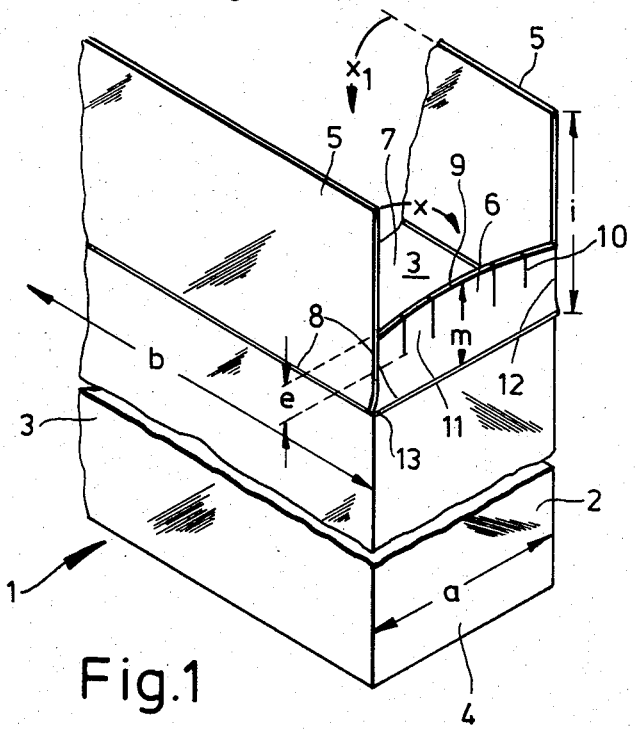
FIG. 1 is a perspective view of part of a box assembled by folding a cardboard blank or pattern.

FIG. 1 shows a box having a pair of narrow sides 2 for example of breadth a of 30 mm, and joining these front and back sides 3—the breadth b of which is not shown here in full—and a base sheet 4. This, together with narrow sides 2 and broader sides 3, forms part of a common cardboard pattern which also features two lid flaps 5 as an extension to the broader sides 3 and two dust flaps 6. These and the lid flaps 5 surround an opening 7, and are delimited by fold lines 8 from the neighboring narrow side 2 or broad side 3. Fold lines **8*b***

Figure 6:
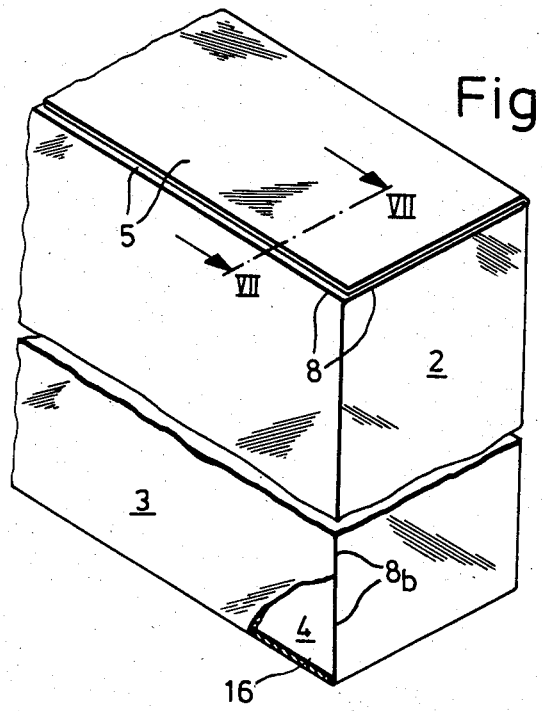
FIG. 6 is a perspective view of a part of the closed box.

(FIG. 6) also run between the narrow and broad sides 2, 3 of the box or container; the normal adhesive flaps to join the cut edges to the body of the box are not shown in the drawing.

The height i of the lid flaps 5 is slightly smaller than the breadth a of the narrow sides 2, while the maximum height m of the dust flap 6 in the example shown is less than 15 mm. Also the upper, leading edge 9 of the dust flap is convexly curved with a radius of curvature r of about 180 mm running towards the base sheet 4. Running from the edge 9 of the dust flap are slits 10 of length e equal to approx. 8 mm—creating individual tongues 11 in the flaps 6.

Figure 8:
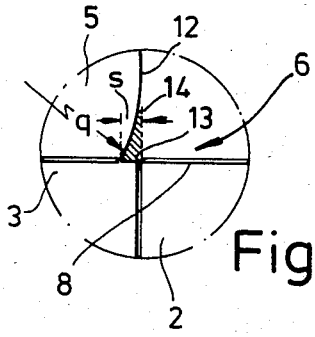
FIG. 8 is an enlarged view of region VIII in FIG. 3.

Also curved are the edges 12 at the sides of dust flaps 6, in such a way that they terminate on the fold line 8 at a distance "s" (e.g. 2 mm) from the point of contact or corner 13 of fold line 8 on the narrow side 2, thus forming, as shown shaded in FIG. 8, a triangular-like peak or field 14. The radius of curvature q for the end or peak region formed by edge 12 is about 10 mm and a concave edge is formed. The radius of curvature q of 10 mm is less than the height m of the dust flap 6 of 15 mm.

Figure 7:
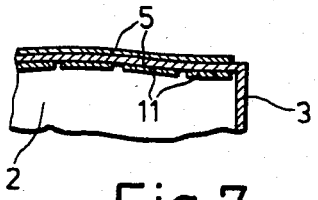
FIG. 7 is a section through FIG. 6 taken along line VII—VII.

After the interior 16 of box 1 has been filled with dustlike contents, the opening 7 in the box 1 is closed by folding the lid flaps 8 about their fold lines 5 in the direction of the arrows x, $x_1$ so that both dust flaps, as shown in FIG. 7 lie against the inner face of the then lower lid flaps 5 with a layer of adhesive (not shown) therebetween.

When the box 1 is closed, as shown in FIG. 8, the outwards drawn edges 12 of the dust flaps 6 ensure that a dust-tight closure is provided; the tongues 11 on flaps 6 produce, with their curved leading edge 9, a close fit against the lid flap 5; on folding over lid flap 5 this presses first against the middle region of dust flap edge 9, which then presses with high edge pressure against the lid flap 5.

A special effect produced by the pressure-developing slits 10—apart from creating the tongues 11—is that they cause the normal chalk layer on the cardboard to be broken through, which leads to improved adhesion and a more intimate bonding of the joint.

According to the version shown in FIGS. 2-4, the edges 12 of the dust flaps 6 beyond the curved part 20 (FIG. 3) delimiting the peak or field 14—are inclined at an angle W, for example of 80°, towards the center line M of the narrow side 2 in such a way that triangular shaped projections 22 are produced at the edges 21 of the lid flaps 5 and, when the box 1 is closed these projections 22 stand out from the body of the box 1.

FIG. 5 shows that these projections 22 can also be folded along a further fold line 18 on the inner side 23 of lid flap 5 thus forming a bead of flap thereat.

What is claimed is:

1. A container of cardboard or similar material comprising a base, side walls on said base, flaps foldably connected to the side walls at respective fold line for closing the container, two of said flaps being dust flaps which are adapted for being folded to close the container and two other of said flaps being lid flaps which are foldable on the dust flaps to cover the same, said dust flaps and lid flaps having adjoining edges of conforming shape, the adjoining edges of said dust flaps extending beyond the fold lines between the dust flaps and the respective side walls thereof to form peak regions joined to the fold lines between the lid flaps and associated side walls, said edges of said dust flaps in said peak region being of concave curvature, and means for bonding said flaps together following closing of the container by folding the lid flaps on the dust flaps, said peak regions acting to form a dust-tight closure at the resulting corners of the container, the side walls for the dust and lid flaps being at an angle to one another, said dust flaps having free leading edges which are convexly curved, said dust flaps being provided with slits which extend from the leading edges of the dust flaps to form tongues in said dust flaps.

2. A container as claimed in claim 1 wherein the container has opposed long side walls and opposed short side walls, said dust flaps being joined to the short side walls, and the lid flaps to the long side walls, each said dust flap having opposite edges which constitute the edges adjoining adjacent lid flaps, each said curved edges of said peak regions at the opposite edges of the dust flap being joined to the respective fold lines between the lid flaps and long side walls.

3. A container as claimed in claim 1 wherein the curved edges of the peak regions extend about one-half of the height of the associated dust flaps.

4. A container as claimed in claim 1 wherein the curved edges of the peak regions have a radius of curvature which is less than the height of the dust flaps.

5. A container as claimed in claim 1 wherein the radius of curvature of said free leading edges of the dust flaps is about 10 times as long as the height of the dust flaps.

6. A container as claimed in claim 1 wherein the length of said slits is about one-half the height of the dust flaps.

7. A container as claimed in claim 1 wherein the height of the dust flaps is less than one-half of the height of the adjoining lid flaps.

8. A container as claimed in claim 1 wherein the height of the lid flaps is approximately equal to the width of an opening of the container.

9. A container as claimed in claim 1 wherein said adjoining edges of the dust flaps extends from said peak regions along a line inclined at an angle towards a center line of the associated side walls to form a triangular shaped projections on the adjoining edges of the lid flaps.

10. A container as claimed in claim 1 wherein said lid flaps have a greater height than the dust flaps.

11. A container of cardboard or similar material comprising a base, side walls on said base, flaps foldably connected to the side walls at respective fold lines for closing the container, two of said flaps being dust flaps which are adapted for being folded to close the container and two other of said flaps being lid flaps which are foldable on the dust flaps to cover the same, said dust flaps and lid flaps having adjoining edges of conforming shape, the adjoining edges of said dust flaps extending beyond the fold lines between the dust flaps and the respective side walls thereof to form peak regions joined to the fold lines between the lid flaps and associated side walls, said edges of said dust flaps in said peak regions being of concave curvature, and means for bonding said flaps together following closing of the container by folding the lid flaps on the dust flaps, said peak regions acting to form a dust-tight closure at the resulting corners of the container, the container having an opening bounded by said fold lines of the flaps, said opening being covered over at least in part by said lid flaps, said dust flaps having leading edges provided with edge slits, the height of each said dust flap being less than one-half of the height of the lid flaps, said edges of the dust flaps being curved bent edges which, when the container is closed, overlap the resulting corners of the container.

* * * * *